US009586229B1

(12) United States Patent
Lee

(10) Patent No.: US 9,586,229 B1
(45) Date of Patent: Mar. 7, 2017

(54) HOT MELT GLUE GUN WITH AN AUTOMATIC GLUE STICK FEEDING STRUCTURE

(71) Applicant: HOMEEASE INDUSTRIAL CORPORATION LTD., Chia Yi Hsien (TW)

(72) Inventor: Grace Lee, Chia Yi Hsien (TW)

(73) Assignee: HOMEEASE INDUSTRIAL CO., LTD. (TW)

( * ) Notice: Subject to any disclaimer, the term of this patent is extended or adjusted under 35 U.S.C. 154(b) by 29 days.

(21) Appl. No.: 14/862,151

(22) Filed: Sep. 22, 2015

(51) Int. Cl.
*B05C 17/005* (2006.01)

(52) U.S. Cl.
CPC ..... *B05C 17/0053* (2013.01)

(58) Field of Classification Search
CPC ..... B05C 17/0053
USPC ..... 222/146.5
See application file for complete search history.

(56) References Cited

U.S. PATENT DOCUMENTS 4,032,046 A * 6/1977 Elliott ..... B27G 11/00 219/421
4,660,743 A * 4/1987 Speisebecher ..... B05C 17/0053 222/146.5
4,938,388 A * 7/1990 Yeh ..... B05C 17/00536 219/241
6,558,059 B1 * 5/2003 Hillinger ..... B05C 17/00536 222/146.2

* cited by examiner

*Primary Examiner* — Donnell Long
(74) *Attorney, Agent, or Firm* — Symbus Law Group LLC; Clifford D. Hyra

(57) ABSTRACT

A hot melt glue gun with an automatic glue stick feeding structure includes a gun-shaped housing, a press button, an automatic glue stick feeding device, a hot melt unit, a nozzle, and a control unit. The automatic glue stick feeding device includes a casing and a synchronous motor having a transmission shaft. The casing includes a transmission gear, an inlet, and at least one gear train having upper and lower gears and a passage. The control unit includes a control printed circuit board, a micro switch, a forward relay output control portion, and a rearward relay output control portion. A glue stick is moved forwards when a user slightly presses the press button. When the press button is not pressed, the glue stick moves rearwards, avoiding continuous dripping of the molten glue through a nozzle.

4 Claims, 6 Drawing Sheets

HOT MELT GLUE GUN WITH AN AUTOMATIC GLUE STICK FEEDING STRUCTURE

BACKGROUND OF THE INVENTION

The present invention relates to a hot melt glue gun and, more particularly, to a gun-shaped hand tool using electricity to generate high heat for melting a glue stick.

With reference to FIG. 6, a conventional hot melt glue gun includes a press button 1' slidable relative to a track of a housing of the hot melt glue gun by provision of a groove 11'. A limiting pin 21' on an end of an arm 2' is inserted into a hole of the press button 1'. The arm 2' is pivotable relative to the housing of the hot melt glue gun about a pivot axis at an intermediate portion of the arm 2'. The other end of the arm 2' can pull an end of a follower plate 3'. The other end of the follower plate 3' is connected to a holding block 4' that is connected to a feeding seat 5' via a pin 41'. The holding block 4' can pivot about the pin 41' to actuate the feeding seat 5' to move rectilinearly. The feeding seat 5' includes a forwardly protruding leg 51' around which a spring 52' is mounted. An end of the spring 52' presses against the housing of the hot melt glue gun. When a user presses the press button 1', the arm 2' actuates the holding block 4' to pivot about the pin 41'. The holding block 4' presses against a glue stick 6' in the feeding seat 5'. When the press button 1' is further pressed, the feeding seat 5' is moved forwards and, thus, moves the glue stick 6' forwards into a hot melt chamber 7'.

However, the forward movement of the glue stick 6' relies on continuously pressing the press button 1' by the user as well as movements of the arm 2', the follower plate 3', the holding block 4' and the feeding seat 5'. Thus, the forward movement of the glue stick 6' cannot easily be achieved by slightly pressing the press button 1'.

Furthermore, the glue stick 6' can only move forwards. Namely, the glue stick 6' cannot move rearwards. Although the glue stick 6' stops when the press button 1' is not pressed, a portion of the glue stick 6' in the hot melt chamber 7' still melt under high heat and, thus, squeezes the molten glue already existing in the hot melt chamber 7'. As a result, the molten glue continuously drips from the nozzle 8', causing a waste.

BRIEF SUMMARY OF THE INVENTION

The primary objective of the present invention is to provide a hot melt glue gun with an automatic glue stick feeding structure to permit forward feeding of a glue stick when a press button is slightly pressed. Furthermore, when the press button is not pressed, the glue stick moves rearwards a small distance, such that the glue stick will not press the molten glue in a hot melt chamber, avoiding continuous dripping of the molten glue through a nozzle.

The above objective is fulfilled by a hot melt glue gun according to the present invention. The hot melt glue gun includes a housing that is gun-shaped and that includes a hole, an inlet, two channels, a through-hole, and a notch. A press button includes two lateral protrusions slidably received in the two channels. The press button further includes a column and a lower protrusion. A spring is mounted around the column. The press button has an end extending beyond the notch of the housing. The spring has an end abutting against the housing. An automatic glue stick feeding device includes a casing and a synchronous motor having a transmission shaft. The casing includes a left casing part, a right casing part, a transmission gear, a feeding sleeve, a bushing, at least one set of gear shafts, at least one set of gear shaft holes, and at least one gear train. The feeding sleeve includes an inlet. The left casing part and the right casing part together clamp the feeding sleeve. The transmission shaft of the synchronous motor is rotatably held by the left casing part and the right casing part. The transmission gear and the bushing are mounted around the transmission shaft of the synchronous motor. The at least one gear train includes an upper gear, a lower gear meshed with the transmission gear, and a passage. The synchronous motor includes a first contact, a second contact, a third contact, and a fourth contact. A hot melt unit includes a nozzle and a heating unit. A control unit includes a control printed circuit board, a micro switch having an actuation rod, a power switch mounted in the hole of the housing, a forward relay output control portion, a rearward relay output control portion, and a signal input control portion. The control printed circuit board is mounted in the housing and includes a first contact, a second contact, a third contact, a sixth contact, a seventh contact, an eighth contact, and a ninth contact. The micro switch is electrically connected to the first, second, and third contacts of the control printed circuit board. The actuation rod of the micro switch faces the lower protrusion of the press button. The power switch is electrically connected to the seventh contact of the control printed circuit board, the synchronous motor, the heating unit, and the micro switch. The forward relay output control portion is electrically connected to the eighth contact of the control printed circuit board. The rearward relay output control portion is electrically connected to the ninth contact of the control printed circuit board.

In an example, the at least one set of gear shafts includes two sets of gear shafts, the at least one gear train includes two gear trains, and the at least one set of gear shaft holes includes two sets of gear shaft holes.

The control unit can further include a temperature controller electrically connected to the power switch and the heating unit.

The control unit can further include an indication lamp. The control printed circuit board can further include a fourth contact and a fifth contact. The indicator lamp is electrically connected to the fourth contact, the fifth contact, and the power switch.

The present invention will become clearer in light of the following detailed description of illustrative embodiments of this invention described in connection with the drawings.

DETAILED DESCRIPTION OF THE INVENTION

Figure 1:
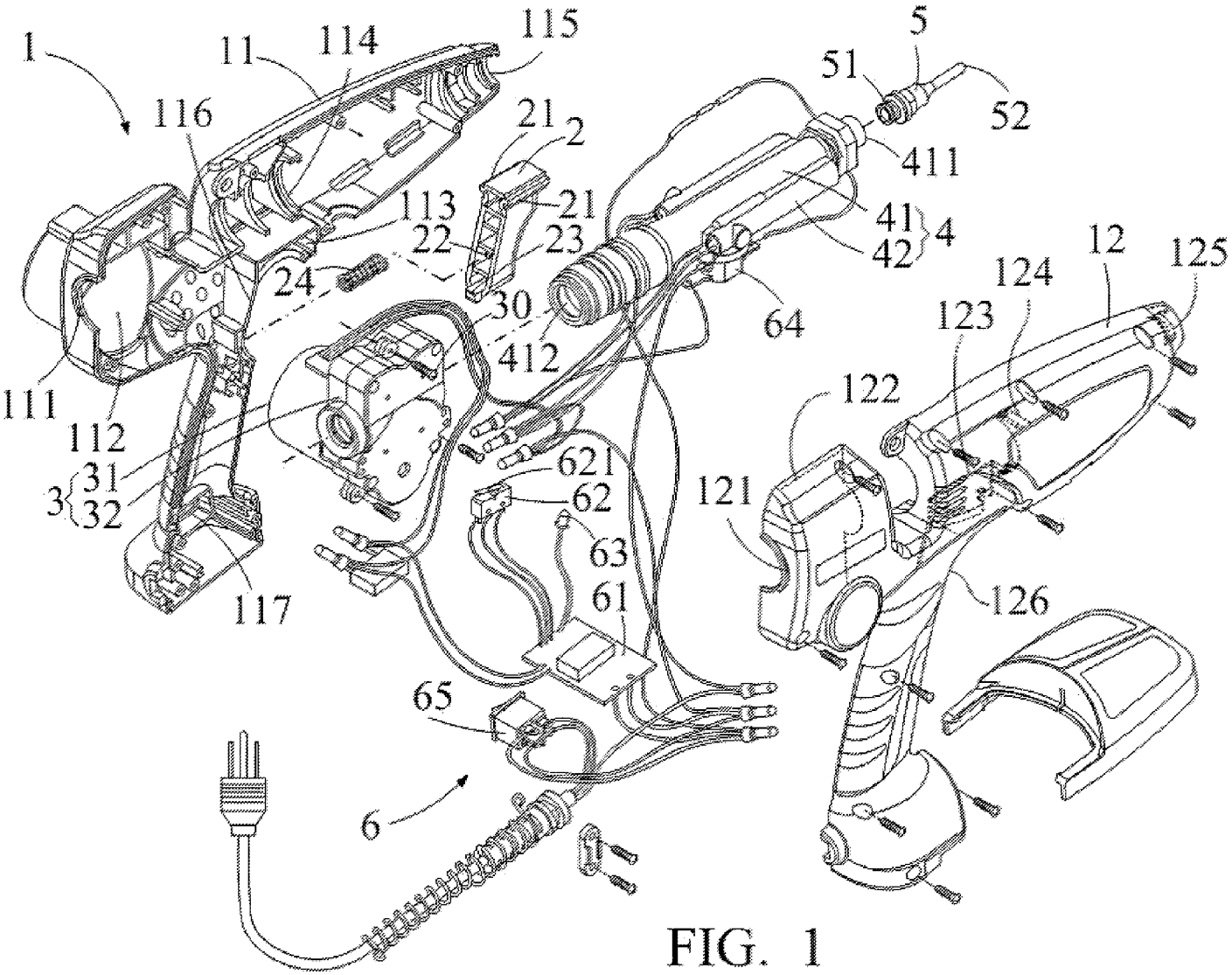
FIG. 1 is an exploded, perspective view of a hot melt glue gun automatic glue stick feeding structure according to the present invention.
Figure 2:
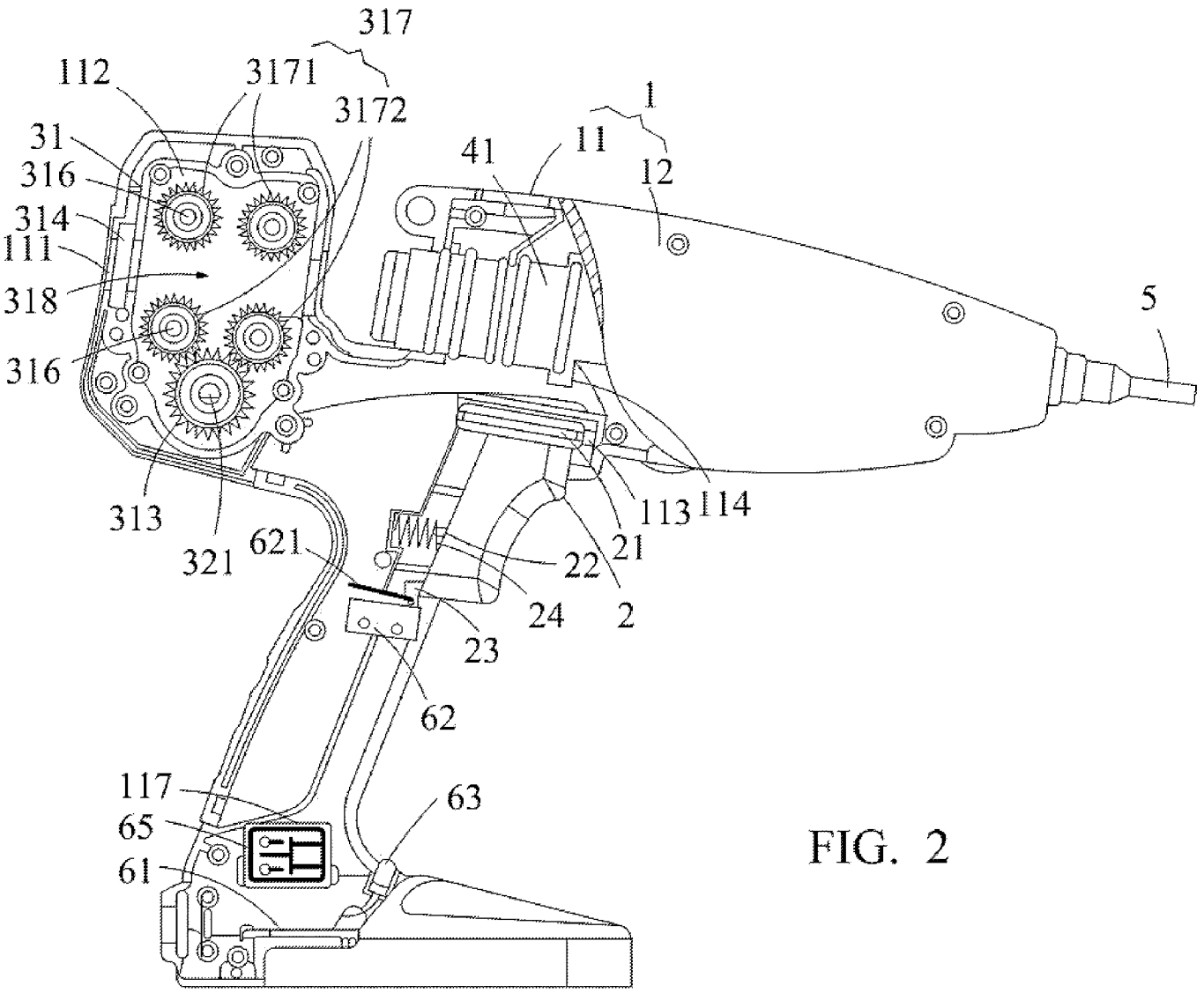
FIG. 2 is a side view of the hot melt glue gun according to the present invention with a portion of the hot melt glue gun cut away.

With reference to FIGS. 1 and 2, a hot melt glue gun with an automatic glue stick feeding structure according to the present invention includes a housing 1, a press button 2, an automatic glue stick feeding device 3, a hot melt unit 4, a nozzle 5, and a control unit 6.

The housing 1 is gun-shaped and includes a left housing part 11 having a hole 117 and a right housing part 12. Each of the left housing part 11 and the right housing part 12 includes a semi-circular inlet 111, 121, a receiving compartment 112, 122, a channel 113, 123, a plurality of semi-circular clamping blocks 114, 124, a semi-circular through-hole 115, 125, and a notch 116, 126. After the left housing part 11 and the right housing part 12 have been assembled to form the housing 1, the semi-circular inlets 111 and 121 together form a circular inlet, the semi-circular clamping blocks 114 and 124 together form a circular clamping block, the semi-circular through-holes 115 and 125 together form a circular through-hole, and the notches 116 and 126 together form a larger notch.

The press button 2 includes two lateral protrusions 21 slidably received in the channels 113 and 123 of the left housing part 11 and the right housing part 12. The press button 2 further includes a column 22 and a lower protrusion 23. An end of the press button 2 extends beyond the notches 116 and 126 of the housing 1. The lateral protrusions 21 slide along the channels 113 and 123 in the forward/rearward direction when the press button 2 is pressed. A spring 24 is mounted around the column 22. An end of the spring 24 abuts against the housing 1. When the press button 2 is not pressed, the spring 24 returns the press button 2 back to its original position.

Figure 3:
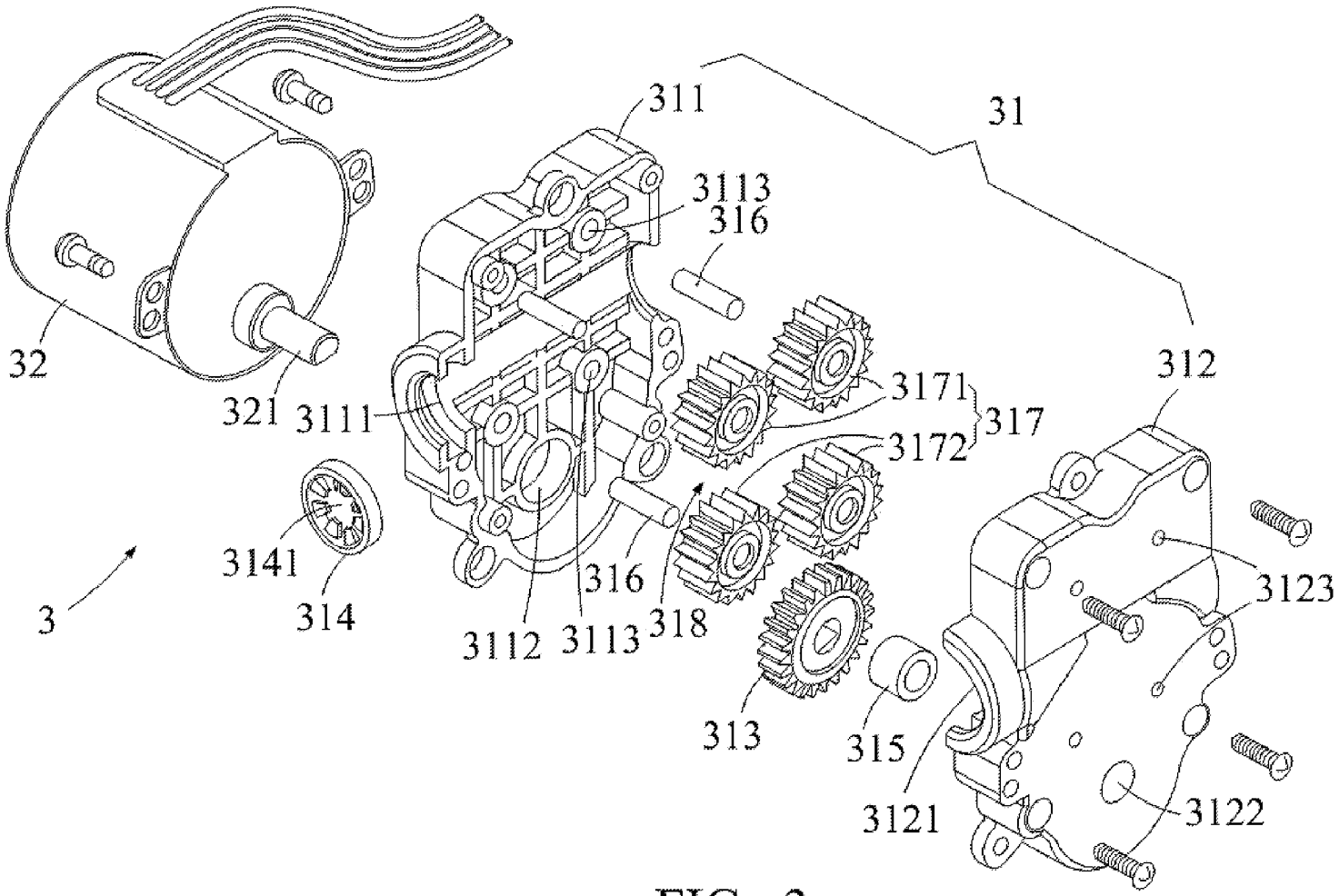
FIG. 3 is an exploded, perspective view of the automatic glue stick feeding structure.

The automatic glue stick feeding device 3 is fixed in the receiving compartments 112 and 122 by fasteners 30, such as screws. With reference to FIG. 3, the automatic glue stick feeding device 3 includes a casing 31 and a synchronous motor 32 having a transmission shaft 321.

The casing 31 includes a left casing part 311, a right casing part 312, a transmission gear 313, a feeding sleeve 314, a bushing 315, at least one set of gear shafts 316 arranged in a vertical direction, and at least one gear train 317 arranged in the vertical direction. The feeding sleeve 314 includes an inlet through which a glue stick can be inserted into the feeding sleeve 314. In the form shown in FIGS. 2 and 3, the casing 31 includes two sets of gear shafts 316 and two gear trains 317. The glue stick can engage with the two gear trains 317 by four contact faces, such that the glue stick can move forward or rearward more easily.

Each of the left casing part 311 and the right casing part 312 has a semi-circular engagement hole 3111, 3121, a transmission shaft hole 3112, 3122, and at least one set of gear shaft holes 3113, 3123. The left casing part 311 and the right casing part 312 together clamp the feeding sleeve 314 received in the engagement holes 3111 and 3121. After the transmission shaft 321 of the synchronous motor 32 is received in the transmission shaft holes 3112 and 3122, the transmission gear 313 and the bushing 315 are mounted around the transmission shaft 321 of the synchronous motor 32. In the form shown in FIGS. 2 and 3, the casing 31 includes two sets of gear shaft holes 3113, 3123 for receiving two ends of the two sets of gear shafts 316 on which the two gear trains 317 are mounted.

Each gear train 317 includes an upper gear 3171 and a lower gear 3172 spaced from and aligned with the upper gear 3171. A passage 318 is formed between the upper gear 3171 and the lower gear 3172. The glue stick extends through the passage 318. An upper portion of each lower gear 3172 and a lower portion of each upper gear 3171 can engage with upper and lower sides of the glue stick, such that the upper and lower gears 3171 and 3172 engage with the glue stick by four contact faces, permitting easier movement for the glue stick. Each lower gear 3172 meshes with the transmission gear 313 below the lower gears 3172. Thus, when the transmission gear 313 is driven to rotate in a clockwise direction (i.e., the forward direction), the two lower gears 3172 are driven to rotate in the counterclockwise direction (i.e., the reverse direction), and the glue stick is moved rearwards. On the other hand, when the transmission gear 313 is driven to rotate in a counterclockwise direction, the two lower gears 3172 are driven to rotate in the clockwise direction, and the glue stick is moved forwards. The casing 31 can easily be replaced when the diameter of the glue stick changes. For example, if the diameter of the glue stick is larger, the passage 318 in each gear train 317 of the casing 31 should be larger. If the diameter of the glue stick is smaller, the passage 318 in each gear train 317 of the casing 31 should be smaller.

The synchronous motor 32 includes a first contact 322 for controlling the transmission shaft 321 to rotate in the reverse direction, a second contact 323 for controlling the transmission shaft to rotate in the forward direction, and third and fourth contacts 324 and 325 electrically connected to a power switch 65.

The hot melt unit 4 includes a tubular hot melt chamber 41 made of metal (such as aluminum) and a heating unit 42 electrically connected to the power switch 65 for generating high heat. The hot melt chamber 41 includes a nozzle end 411 and an open end 412 in communication with the nozzle end 411. The open end 412 is aligned with the passage 318 of the casing 31 and receives the glue stick. The heating unit 42 is fixed to an outer wall of the hot melt chamber 41. The high heat generated by the heating unit 42 melts the glue stick in the hot melt chamber 41 via the outer wall of the hot melt chamber 41.

The nozzle 5 is tubular and is made of metal (such as aluminum). The nozzle 5 includes a threaded portion 51 and an outlet 52. The threaded portion 51 is in threading connection with the nozzle end 411 to couple the nozzle 5 with the heating unit 42 as an integral part. The molten glue in the hot melt chamber 41 can flow outwards via the outlet 52.

Figure 4:
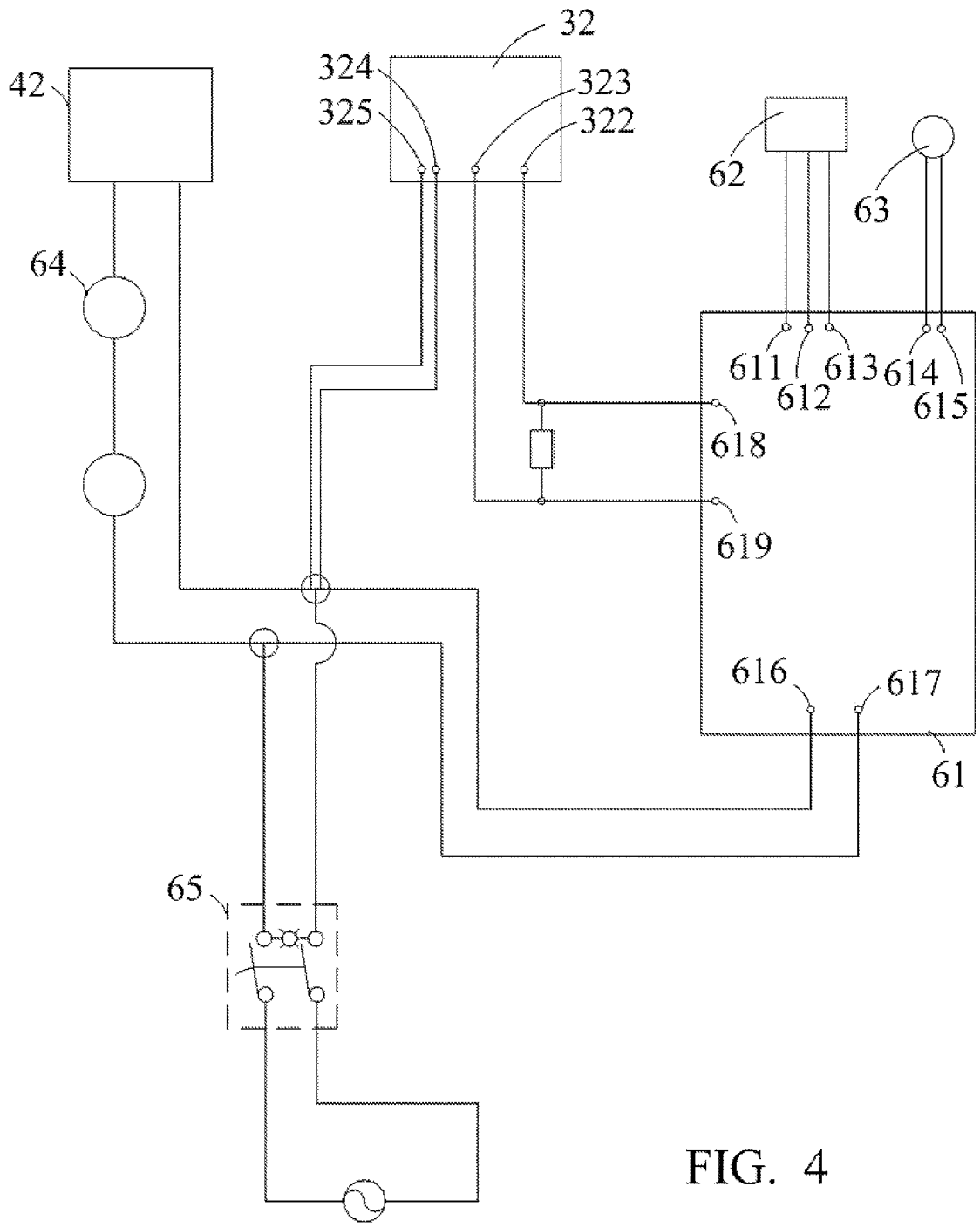
FIG. 4 is a circuitry of the hot melt glue gun according to the present invention.
Figure 5:
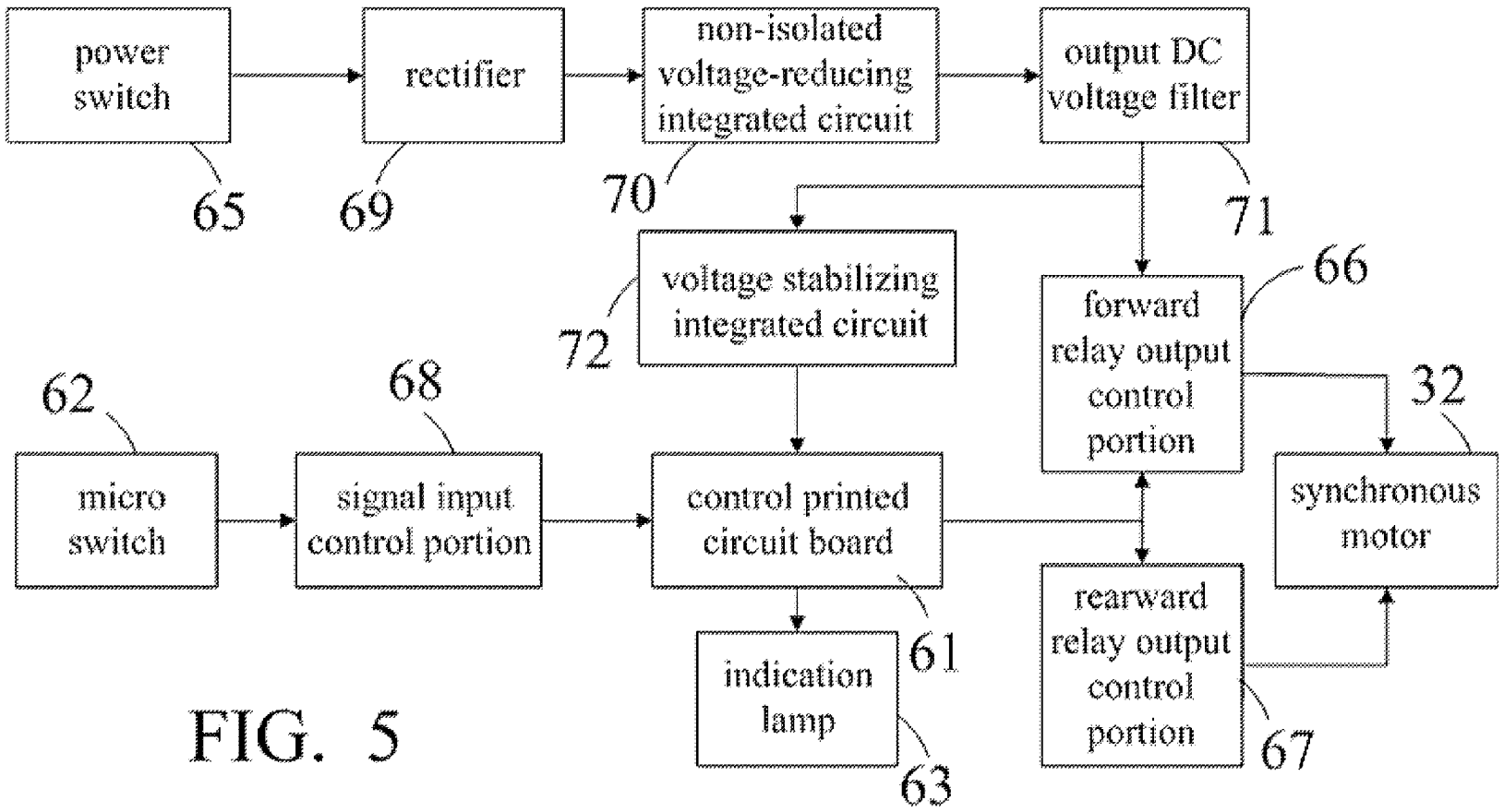
FIG. 5 is a block diagram of a control printed circuit board according to the present invention.
Figure 6:
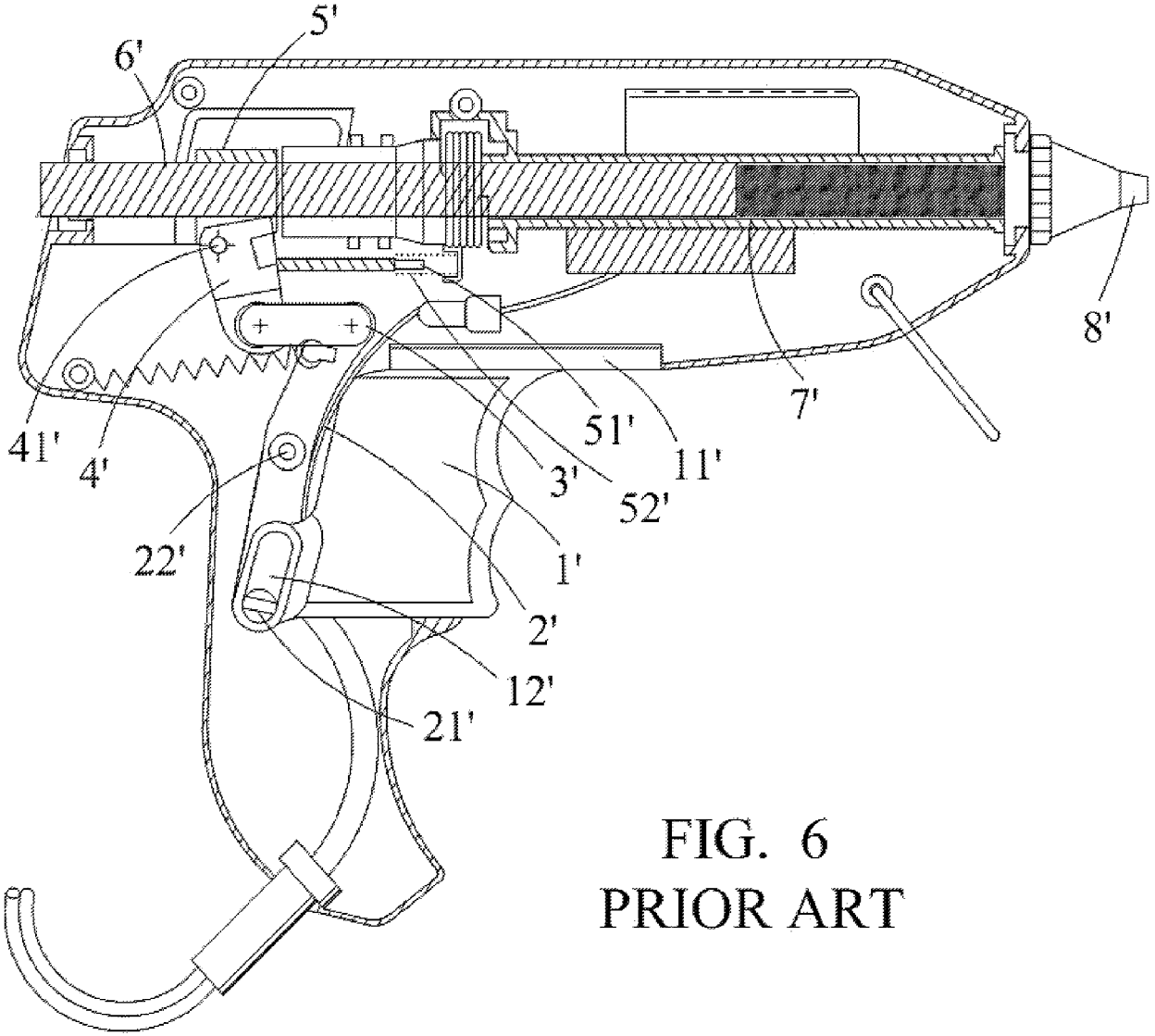
FIG. 6 PRIOR ART
FIG. 6 is a cross sectional view of a conventional hot melt glue gun.

With reference to FIGS. 4 and 5, the control unit 6 includes a control printed circuit board 61 capable of processing signals, a micro switch 62 having an actuation rod 621, an indication lamp 63 indicating the hot melt glue gun has already been heated and is ready for use, a temperature controller 64, the power switch 65 mounted in the hole 117 of the housing 1, a forward relay output control portion 66 electrically connected to the synchronous motor 32 for controlling the transmission shaft 321 to rotate in the reverse direction, a rearward relay output control portion 67 electrically connected to the synchronous motor 32 for controlling the transmission shaft 321 to rotate in the forward direction, and a signal input control portion 68. Nevertheless, the present invention is not limited to these elements. As shown in FIG. 5, the control unit 6 can further include other auxiliary electronic elements, such as a rectifier 69, a non-isolated voltage-reducing integrated circuit 70, an output DC voltage filter 71, and a voltage stabilizing integrated circuit 72.

The control printed circuit board 61 is mounted in the housing 1 and includes a printed circuit and a first contact 611, a second contact 612, a third contact 613, a fourth contact 614, a fifth contact 615, a sixth contact 616, a seventh contact 617, an eighth contact 618, and a ninth contact 619 that are electrically connected to the printed circuit. The micro switch 62 is electrically connected to the first, second, and third contacts 611, 612, 613 of the control printed circuit board 61. The actuation rod 621 of the micro switch 62 faces the lower protrusion 23 of the press button 2. Thus, when the press button 2 is pressed and moves rearwards, the lower protrusion 23 presses against the actuation rod 621 of the micro switch 62 to output an ON signal to the control printed circuit board 61. On the other hand, when the press button 62 is not pressed, the returning force of the spring 24 moves the press button 2 forwards, such that the lower protrusion 23 no longer presses against the actuation rod 621 of the micro switch 62, and such that an OFF signal is outputted to the control printed circuit board 61.

The indicator lamp 63 is electrically connected to the fourth contact 614 and the fifth contact 615 of the control printed circuit board 61. The indicator lamp 63 can be actuated by the control printed circuit board 61 to be in an ON state to indicate that heating of the hot melt glue gun has been finished and that the hot melt glue gun is ready for use. The temperature controller 64 is electrically connected to the heating unit 42 to control the temperature of the heating unit 42.

The power switch 65 is electrically connected to the sixth and seventh contacts 616 and 617 of the control printed circuit board 61, the synchronous motor 32, the heating unit 42, the micro switch 62, the indicator lamp 63, and the temperature controller 64. The power switch 65 can be manually turned on or off to control these electrically connected elements. The forward relay output control portion 66 is electrically connected to the eighth contact 618 of the control printed circuit board 61, such that the forward relay output control portion 66 can be controlled by the control printed circuit board 61. The rearward relay output control portion 67 is electrically connected to the ninth contact 619 of the control printed circuit board 61, such that the rearward relay output control portion 67 can be controlled by the control printed circuit board 61.

In operation, with reference to FIGS. 4 and 5, the power switch 65 is turned on to provide electricity to the electrically connected elements, such as the rectifier 69, the non-isolated voltage-reducing integrated circuit 70, the output DC voltage filter 71, the voltage stabilizing integrated circuit 72, the heating unit 42, and the control printed circuit board 61. The heating unit 42 starts to generate high heat that is transmitted through the outer wall of the hot melt chamber 41 to melt the glue stick in the hot melt chamber 41.

When the user slightly presses the press button 2 to make the lower protrusion 23 press against the actuation rod 621 of the micro switch 62, the signal input control portion 68 is actuated to output an ON signal to the control printed circuit board 61, which, in turn, outputs an ON signal to the forward relay output control portion 66. Thus, the first contact 322 of the synchronous motor 32 forms a closed circuit, and the transmission shaft 321 and the transmission gear rotate in the rearward direction to drive the two lower gears 3172 to rotate in the forward direction. The glue stick engaged with the two lower gears 3712 is, thus, moved forwards.

When the press button 2 is not pressed, the return force of the spring 24 moves the press button 2 back to the original position, and the lower protrusion 23 no longer presses against the actuation rod 621 of the micro switch 62. The signal input control portion 68 is actuated to output an OFF signal to the control printed circuit board 61, which, in turn, outputs an OFF signal to the rearward relay output control portion 67. Thus, the first contact 322 of the synchronous motor 32 forms an open circuit, and the transmission shaft 321 and the transmission gear rotate in the forward direction to drive the two lower gears 3172 to rotate in the rearward direction. The glue stick engaged with the two lower gears 3172 is, thus, moved rearwards a small distance, such that the glue stick will not press the molten glue in the hot melt chamber 41, avoiding continuous dripping of the molten glue through the nozzle 5.

Although specific embodiments have been illustrated and described, numerous modifications and variations are still possible without departing from the scope of the invention. The scope of the invention is limited by the accompanying claims.

The invention claimed is:

1. A hot melt glue gun with an automatic glue stick feeding structure, comprising:

a housing, with the housing being gun-shaped and including a hole, an inlet, two channels, a through-hole, and a notch;

a press button including two lateral protrusions slidably received in the two channels, with the press button further including a column and a lower protrusion, with a spring mounted around the column, with the press button having an end extending beyond the notch of the housing, and with the spring having an end abutting against the housing;

an automatic glue stick feeding device including a casing and a synchronous motor having a transmission shaft, with the casing including a left casing part, a right casing part, a transmission gear, a feeding sleeve, a bushing, at least one set of gear shafts, at least one set of gear shaft holes, and at least one gear train, with the feeding sleeve including an inlet, with the left casing part and the right casing part together clamping the feeding sleeve, with the transmission shaft of the synchronous motor rotatably held by the left casing part and the right casing part, with the transmission gear and the bushing mounted around the transmission shaft of the synchronous motor, with the at least one gear train including an upper gear, a lower gear meshed with the transmission gear, and a passage, with the synchronous motor including a first contact, a second contact, a third contact, and a fourth contact;

a hot melt unit including a nozzle and a heating unit; and a control unit including a control printed circuit board, a micro switch having an actuation rod, a power switch mounted in the hole of the housing, a forward relay output control portion, a rearward relay output control portion, and a signal input control portion, with the control printed circuit board mounted in the housing and including a first contact, a second contact, a third contact, a sixth contact, a seventh contact, an eighth contact, and a ninth contact, with the micro switch electrically connected to the first, second, and third contacts of the control printed circuit board, with the actuation rod of the micro switch facing the lower protrusion of the press button, with the power switch electrically connected to the seventh contact of the control printed circuit board, the synchronous motor, the heating unit, and the micro switch, with the forward relay output control portion electrically connected to the eighth contact of the control printed circuit board, and with the rearward relay output control portion electrically connected to the ninth contact of the control printed circuit board.

2. The hot melt glue gun with an automatic glue stick feeding structure as claimed in claim 1, with the at least one set of gear shafts including two sets of gear shafts, with the at least one gear train including two gear trains, and with the at least one set of gear shaft holes including two sets of gear shaft holes.

3. The hot melt glue gun with an automatic glue stick feeding structure as claimed in claim 1, wherein the control unit further includes a temperature controller electrically connected to the power switch and the heating unit.

4. The hot melt glue gun with an automatic glue stick feeding structure as claimed in claim 1, with the control unit further including an indication lamp, with the control printed circuit board further including a fourth contact and a fifth contact, and with the indicator lamp electrically connected to the fourth contact, the fifth contact, and the power switch.

* * * * *